US012161169B2

(12) United States Patent
Lee

(10) Patent No.: US 12,161,169 B2
(45) Date of Patent: Dec. 10, 2024

(54) AEROSOL GENERATING DEVICE, AND METHOD AND DEVICE FOR CONTROLLING AEROSOL GENERATING DEVICE

(71) Applicant: KT&G CORPORATION, Daejeon (KR)

(72) Inventor: Jae Min Lee, Siheung-si (KR)

(73) Assignee: KT&G CORPORATION, Daejeon (KR)

( * ) Notice: Subject to any disclaimer, the term of this patent is extended or adjusted under 35 U.S.C. 154(b) by 524 days.

(21) Appl. No.: 16/959,266

(22) PCT Filed: Oct. 23, 2019

(86) PCT No.: PCT/KR2019/013999
§ 371 (c)(1),
(2) Date: Jun. 30, 2020

(87) PCT Pub. No.: WO2020/101204
PCT Pub. Date: May 22, 2020

(65) Prior Publication Data

US 2020/0329776 A1 Oct. 22, 2020

(30) Foreign Application Priority Data

Nov. 16, 2018 (KR) ..... 10-2018-0141971

(51) Int. Cl.
*A24F 40/60* (2020.01)
*A24F 40/51* (2020.01)
(Continued)

(52) U.S. Cl.
CPC ..... *A24F 40/60* (2020.01); *A24F 40/51* (2020.01); *A24F 40/53* (2020.01); *A24F 40/57* (2020.01)

(58) Field of Classification Search
CPC ..... A24F 40/50; A24F 40/10; A24F 40/53; A24F 40/90; A24F 40/20; A24F 40/46;
(Continued)

(56) References Cited

U.S. PATENT DOCUMENTS 9,532,600 B2 1/2017 Thorens et al.
10,194,697 B2 2/2019 Fernando et al.
(Continued)

FOREIGN PATENT DOCUMENTS

CN 101977522 A 2/2011
CN 103974638 A 8/2014
(Continued)

OTHER PUBLICATIONS

Notice of Reasons of Refusal issued May 11, 2021 by the Japanese Patent Office In Japanese Application No. 2020-535993.
(Continued)

*Primary Examiner* — Michael H. Wilson
*Assistant Examiner* — Stephanie Lynn Moore
(74) *Attorney, Agent, or Firm* — Sughrue Mion, PLLC

(57) ABSTRACT

Provided is a device for generating an aerosol, the device including: a heater that generates the aerosol by heating an aerosol generating material; and a controller that variably increases an amount of power supplied to the heater to heat the aerosol generating material at a preheating temperature lower than a heating temperature for generating the aerosol.

9 Claims, 17 Drawing Sheets

(51) Int. Cl.
*A24F 40/53* (2020.01)
*A24F 40/57* (2020.01)

(58) Field of Classification Search
CPC ..... A24F 40/60; A24F 40/95; A24F 15/01; A24F 40/40; A24F 40/485; A24F 40/51; A24F 40/57; A24F 40/65; A24F 47/00; A24B 15/16; A24B 15/167; A24D 1/20; A24D 3/04; A24D 3/06; A24D 3/08; A24D 3/17; A61M 11/042; A61M 15/008; A61M 15/06; A61M 2016/0024; A61M 2205/0238; A61M 2205/14; A61M 2205/215; A61M 2205/3368; A61M 2205/3606; A61M 2205/364; A61M 2205/368; A61M 2205/8206; A61M 2205/8237; A61M 2209/086
See application file for complete search history.

(56) References Cited

U.S. PATENT DOCUMENTS

| | | | | |
|---|---|---|---|---|
| 10,624,393 | B2 | 4/2020 | Kuczaj | |
| 10,645,971 | B2 | 5/2020 | Zitzke | |
| 10,869,503 | B2 | 12/2020 | Yamada et al. | |
| 11,395,515 | B2 | 7/2022 | Talon | |
| 2014/0202476 | A1 | 7/2014 | Egoyants et al. | |
| 2016/0057811 | A1* | 2/2016 | Alarcon | A24F 40/50 219/494 |
| 2016/0374397 | A1 | 12/2016 | Jordan et al. | |
| 2017/0042251 | A1 | 2/2017 | Yamada et al. | |
| 2018/0042306 | A1* | 2/2018 | Atkins | A61M 11/042 |
| 2018/0084608 | A1 | 3/2018 | Bernauer et al. | |
| 2018/0271155 | A1 | 9/2018 | Baker et al. | |
| 2020/0359681 | A1 | 11/2020 | Han et al. | |

FOREIGN PATENT DOCUMENTS

| | | | |
|---|---|---|---|
| CN | 104470386 | A | 3/2015 |
| CN | 106102492 | A | 11/2016 |
| CN | 106231936 | A | 12/2016 |
| EP | 3138424 | A1 | 3/2017 |
| JP | 2004-212585 | A | 7/2004 |
| JP | 2014-518096 | A | 7/2014 |
| JP | 2018-93877 | A | 6/2018 |
| KR | 10-2013-0139276 | A | 12/2013 |
| KR | 10-2015-0102924 | A | 9/2015 |
| KR | 10-1614171 | B1 | 4/2016 |
| KR | 10-1792905 | B1 | 11/2017 |
| KR | 10-2018-0044978 | A | 5/2018 |
| KR | 10-2018-0070443 | A | 6/2018 |
| KR | 10-2018-0111460 | A | 10/2018 |
| WO | 2009/118085 | A1 | 10/2009 |
| WO | 2017/037457 | A1 | 3/2017 |
| WO | 2018-190589 | A3 | 10/2018 |

OTHER PUBLICATIONS

Office Action issued Jan. 5, 2022 in Japanese Application No. 2020-535993.
Supplementary European Search Report issued Feb. 24, 2022 in European Application No. 19883985.4.
Office Action dated Aug. 16, 2022 issued by the Japanese Patent Office in Japanese Application No. 2020-535993.
International Search Report of PCT/KR2019/013999 dated Jan. 29, 2020 [PCT/ISA/210].
Communication dated Dec. 24, 2020, from the Korean Intellectual Property Office in application No. 10-2018-0141971.
Communication dated Jun. 10, 2020, from the Korean Intellectual Property Office in application No. 10- 2018-0141971.
Office Action issued Nov. 10, 2022 in Chinese Application No. 201980006350.X.

* cited by examiner

AEROSOL GENERATING DEVICE, AND METHOD AND DEVICE FOR CONTROLLING AEROSOL GENERATING DEVICE

CROSS REFERENCE TO RELATED APPLICATIONS

This application is a National Stage of International Application No. PCT/KR2019/01399, filed Oct. 23, 2019, claiming priority to Korean Patent Application No. 10-2018-0141971, filed Nov. 16, 2018.

TECHNICAL FIELD

The present disclosure relates to an aerosol generating device and a method of control of the aerosol generating device, and more particularly, to a method of reducing power consumption of a heater and efficiently heating the heater by adjusting power supplied to the heater.

BACKGROUND ART

Recently, the demand for alternative methods of overcoming the shortcomings of general cigarettes has increased. For example, there is growing demand for a method of generating aerosol by heating an aerosol generating material in cigarettes, rather than by burning cigarettes. Accordingly, studies on a heating-type cigarette or a heating-type aerosol generating device have been actively conducted.

Upon a user's puff, a heater may heat an aerosol generating material at a temperature sufficient to generate aerosol. In this case, it is necessary to reduce the waste of power while maintaining the temperature of the heater appropriately until the next puff.

DESCRIPTION OF EMBODIMENTS

Technical Problem

An amount of power supplied to a heater may be variably adjusted to maintain a temperature of the heater at an appropriate level between consecutive puffs of a user to thereby increase smoking satisfaction of the user and reduce power consumption.

Solution to Problem

According to an aspect of the present disclosure, a device for generating aerosol may include: a heater that generates the aerosol by heating an aerosol generating material; and a controller that variably increases an amount of power supplied to the heater to heat the aerosol generating material at a preheating temperature lower than a heating temperature for generating the aerosol.

According to another aspect of the present disclosure, a method of control of an aerosol generating device including a heater generating aerosol by heating an aerosol generating material, may include: as a puff is detected, controlling an amount of power supplied to the heater to heat the aerosol generating material at a heating temperature for generating the aerosol; reducing the amount of power supplied to the heater to maintain a temperature of the aerosol generating material, which is heated at the heating temperature, at a preheating temperature lower than the heating temperature; and as heat energy remaining in the heater decreases, increasing the amount of power supplied to the heater to maintain the temperature of the aerosol generating material at the preheating temperature.

Advantageous Effects of Disclosure

According to embodiments, aerosol may be quickly provided on a user's puff by maintaining a temperature of a heater at an appropriate level.

According to embodiments, the amount of power supplied to the heater may be variably adjusted to maintain the temperature of the heater at the appropriate level to thereby reduce power consumption.

MODE OF DISCLOSURE

With respect to the terms in the various embodiments, the general terms which are currently and widely used are selected in consideration of functions of structural elements in the various embodiments of the present disclosure. However, meanings of the terms may be changed according to intention of one of ordinary skill in the art, a judicial precedence, the appearance of a new technology, and the like. In addition, in certain cases, a term which is not commonly used may be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and may be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

Figure 1:
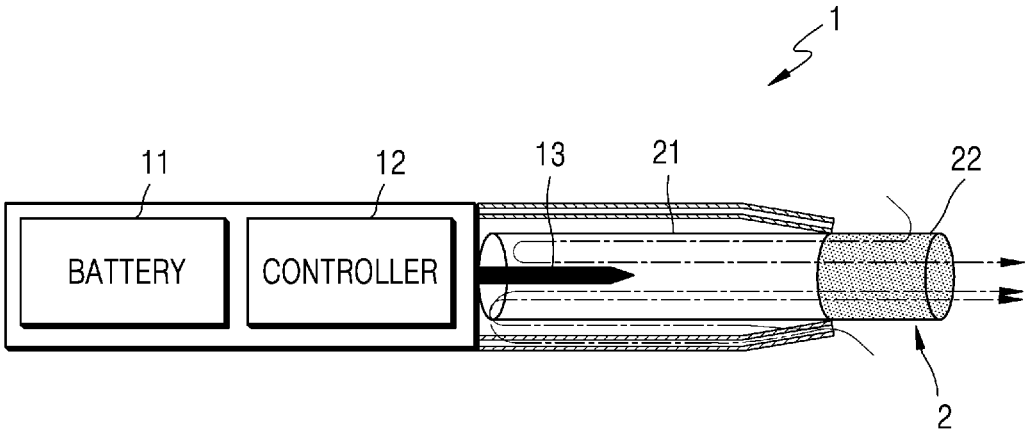
FIGS. 1 through 3 are diagrams showing examples in which a cigarette is inserted into an aerosol generating device.
Figure 2:
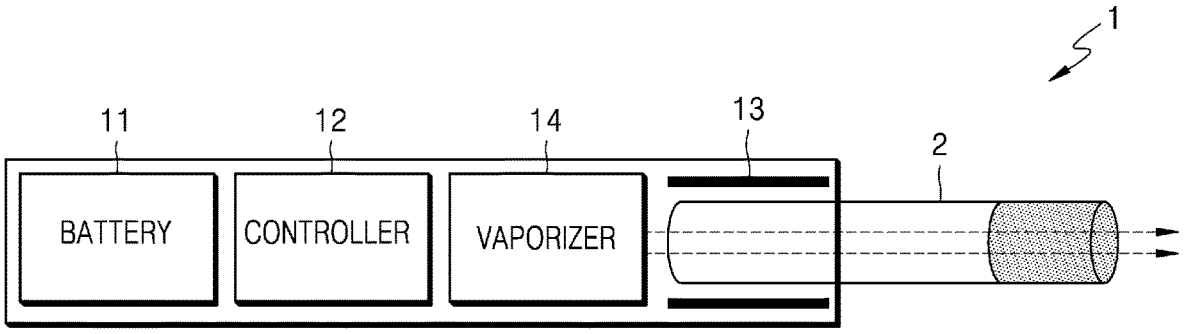
Figure 3:
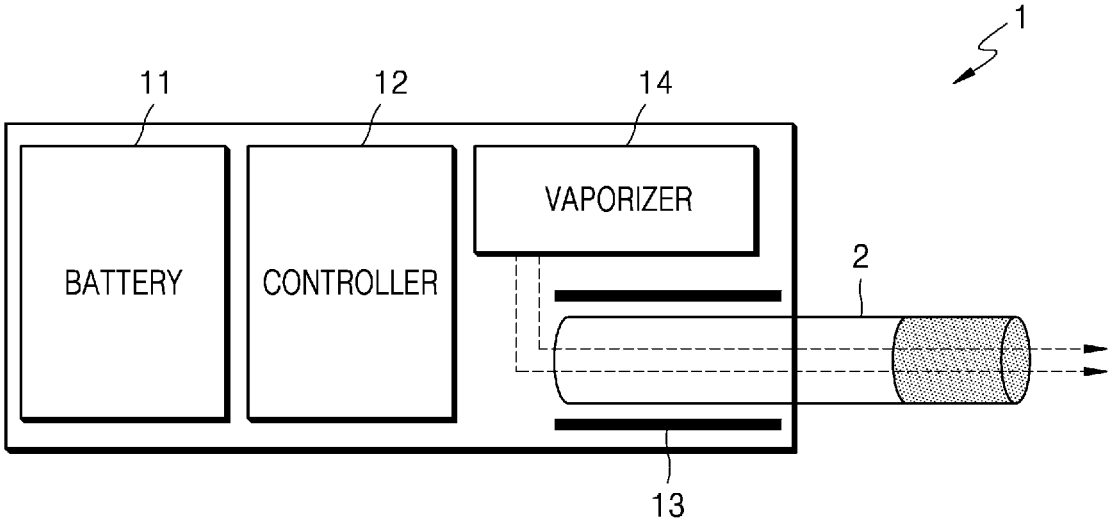

FIGS. 1 through 3 are diagrams showing examples in which a cigarette is inserted into an aerosol generating device.

Referring to FIG. 1, the aerosol generating device 1 may include a battery 11, a controller 12, and a heater 13. Referring to FIGS. 2 and 3, the aerosol generating device 1 may further include a vaporizer 14. Also, the cigarette 2 may be inserted into an inner space of the aerosol generating device 1.

FIGS. 1 through 3 illustrate components of the aerosol generating device 1, which are related to the present embodiment. Therefore, it will be understood by one of ordinary skill in the art related to the present embodiment that other general-purpose components may be further included in the aerosol generating device 1, in addition to the components illustrated in FIGS. 1 through 3.

Also, FIGS. 2 and 3 illustrate that the aerosol generating device 1 includes the heater 13. However, as necessary, the heater 13 may be omitted.

FIG. 1 illustrates that the battery 11, the controller 12, and the heater 13 are arranged in series. Also, FIG. 2 illustrates that the battery 11, the controller 12, the vaporizer 14, and the heater 13 are arranged in series. Also, FIG. 3 illustrates that the vaporizer 14 and the heater 13 are arranged in parallel. However, the internal structure of the aerosol generating device 1 is not limited to the structures illustrated in FIGS. 1 through 3. In other words, according to the design of the aerosol generating device 1, the battery 11, the controller 12, the heater 13, and the vaporizer 14 may be differently arranged.

When the cigarette 2 is inserted into the aerosol generating device 1, the aerosol generating device 1 may operate the heater 13 and/or the vaporizer 14 to generate aerosol from the cigarette 2 and/or the vaporizer 14. The aerosol generated by the heater 13 and/or the vaporizer 14 is delivered to a user by passing through the cigarette 2.

As necessary, even when the cigarette 2 is not inserted into the aerosol generating device 1, the aerosol generating device 1 may heat the heater 13.

The battery 11 may supply power to be used for the aerosol generating device 1 to operate. For example, the battery 11 may supply power to heat the heater 13 or the vaporizer 14, and may supply power for operating the controller 12. Also, the battery 11 may supply power for operations of a display, a sensor, a motor, etc. mounted in the aerosol generating device 1.

The controller 12 may generally control operations of the aerosol generating device 1. In detail, the controller 12 may control not only operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the cigarette 2 is inserted into the aerosol generating device 1, the heater 13 may be located outside the cigarette 2. Thus, the heated heater 13 may increase a temperature of an aerosol generating material in the cigarette 2.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol generating device 1 or may be set as a temperature desired by a user.

As another example, the heater 13 may include an induction heater. In detail, the heater 13 may include an electrically conductive coil for heating a cigarette in an induction heating method, and the cigarette may include a susceptor which may be heated by the induction heater.

For example, the heater 13 may include a tube-type heating element, a plate-type heating element, a needle-type heating element, or a rod-type heating element, and may heat the inside or the outside of the cigarette 2, according to the shape of the heating element.

Also, the aerosol generating device 1 may include a plurality of heaters 13. Here, the plurality of heaters 13 may be inserted into the cigarette 2 or may be arranged outside the cigarette 2. Also, some of the plurality of heaters 13 may be inserted into the cigarette 2 and the others may be arranged outside the cigarette 2. In addition, the shape of the heater 13 is not limited to the shapes illustrated in FIGS. 1 through 3 and may include various shapes.

The vaporizer 14 may generate aerosol by heating a liquid composition and the generated aerosol may pass through the cigarette 2 to be delivered to a user. In other words, the aerosol generated via the vaporizer 14 may move along an air flow passage of the aerosol generating device 1 and the air flow passage may be configured such that the aerosol generated via the vaporizer 14 passes through the cigarette 2 to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol generating device 1 may further include other components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may include at least one sensor (a puff detecting sensor, a temperature detecting sensor, a cigarette insertion detecting sensor, etc.). Also, the aerosol generating device 1 may be formed as a structure where, even when the cigarette 2 is inserted into the aerosol generating device 1, external air may be introduced or internal air may be discharged.

Although not illustrated in FIGS. 1 through 3, the aerosol generating device 1 and an additional cradle may form together a system. For example, the cradle may be used to charge the battery 11 of the aerosol generating device 1. Alternatively, the heater 13 may be heated when the cradle and the aerosol generating device 1 are coupled to each other.

The cigarette 2 may be similar to a general combustive cigarette. For example, the cigarette 2 may be divided into a first portion including an aerosol generating material and a second portion including a filter, etc. Alternatively, the second portion of the cigarette 2 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1, or the entire first portion and a portion of the second portion may be inserted into the aerosol generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1. For example, opening and closing of the air passage and/or a size of the air passage may be controlled by the user. Accordingly, the amount and smoothness of vapor may be adjusted by the user. As another example, the external air may flow into the cigarette 2 through at least one hole formed in a surface of the cigarette 2.

Hereinafter, an example of the cigarette 2 will be described with reference to FIGS. 4 and 5.

Figure 4:
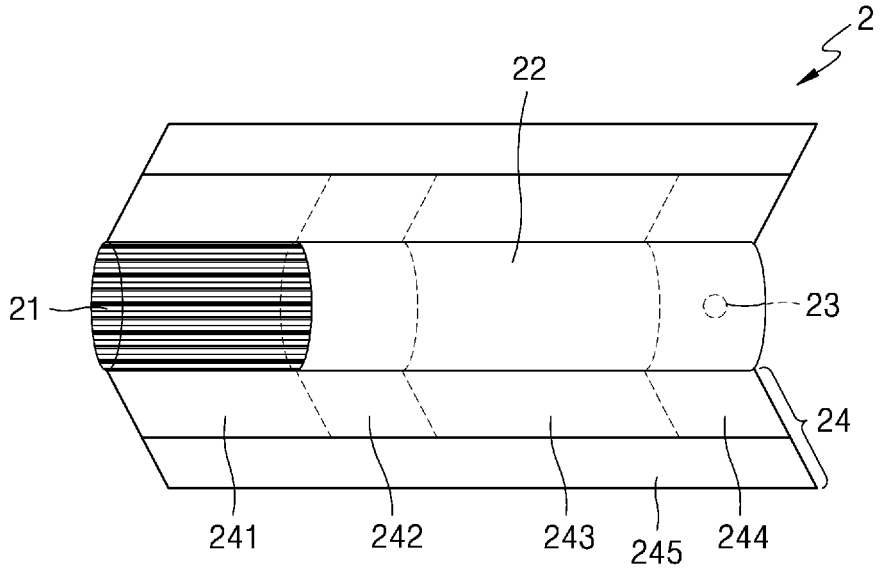
FIGS. 4 and 5 are views illustrating examples of a cigarette.
Figure 5:
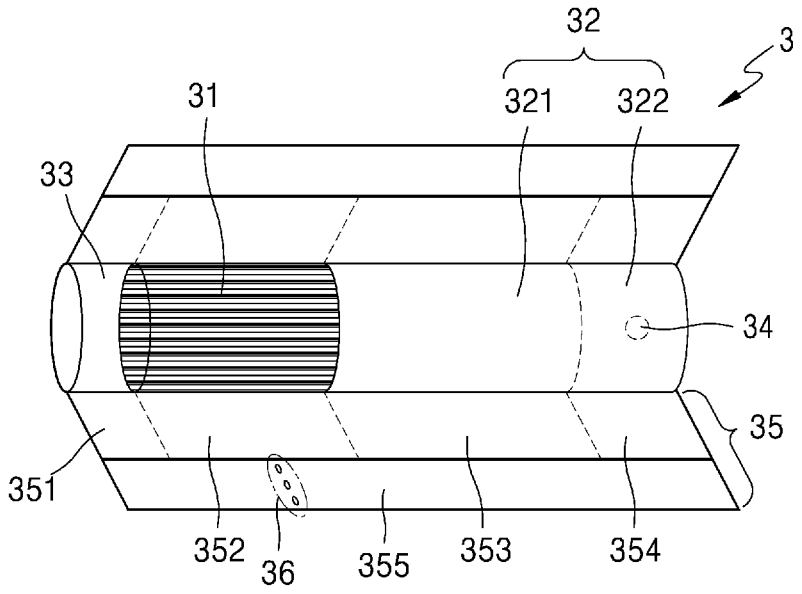

FIGS. 4 and 5 are diagrams showing examples of cigarettes.

Referring to FIG. 4, the cigarette 2 may include a tobacco rod 21 and a filter rod 22. The first portion 21000 described above with reference to FIGS. 1 through 3 may include the tobacco rod, and the second portion may include the filter rod 22.

FIG. 4 illustrates that the filter rod 22 includes a single segment. However, the filter rod 22 is not limited thereto. In other words, the filter rod 22 may include a plurality of segments. For example, the filter rod 22 may include a first segment configured to cool an aerosol and a second segment configured to filter a certain component included in the aerosol. Also, as necessary, the filter rod 22 may further include at least one segment configured to perform other functions.

A diameter of the cigarette 2 may be within a range of 5 mm to 9 mm, and a length of the cigarette 2 may be about 48 mm, but embodiments are not limited thereto. For example, a length of the tobacco rod 21 may be about 12 mm, a length of a first segment of the filter rod 22 may be about 10 mm, a length of a second segment of the filter rod 22 may be about 14 mm, and a length of a third segment of the filter rod 22 may be about 12 mm, but embodiments are not limited thereto.

The cigarette 2000 may be wrapped using at least one wrapper 24. The wrapper 24 may have at least one hole through which external air may be introduced or internal air may be discharged. For example, the cigarette 2 may be wrapped using one wrapper 24. As another example, the cigarette 2 may be double-wrapped using at least two wrappers 24. For example, the tobacco rod 21 may be wrapped using a first wrapper 241, and the filter rod 22 may be wrapped using wrappers 242, 243, 244. In addition, the cigarette 2 may be re-wrapped by a single wrapper 245. When each of the tobacco rod 21 and the filter rod 22 includes a plurality of segments, each segment may be wrapped using wrappers 242, 243, 244.

The first wrapper 241 and the second wrapper 242 may be formed of general filter wrapping paper. For example, the first wrapper 241 and the second wrapper 242 may be porous wrapping paper or non-porous wrapping paper. Also, the first wrapper 241 and the second wrapper 242 may be made of an oil-resistant paper sheet and an aluminum laminate packaging material.

The third wrapper 243 may be made of a hard wrapping paper. For example, a basis weight of the third wrapper 243 may be within a range of 88 $g/m^2$ to 96 $g/m^2$. Preferably, it may be within a range of 90 $g/m^2$ to 94 $g/m^2$. Also, a total thickness of the third wrapper 243 may be within a range of 120 μm to 130 μm. Preferably, it may be 125 μm.

The fourth wrapper 244 may be made of an oil-resistant hard wrapping paper. For example, the basis weight of the fourth wrapper 244 may be within a range of about 88 $g/m^2$ to about 96 $g/m^2$. Preferably, it may be within a range of 90 $g/m^2$ to 94 $g/m^2$. Also, a total thickness of the fourth wrapper 244 may be within a range of 120 μm to 130 μm. Preferably, it may be 125 μm.

The fifth wrapper 245 may be made of a sterilized paper (MFW). Here, the MFW refers to a paper specially manufactured to have enhanced tensile strength, water resistance, smoothness, and the like, compared to ordinary paper. For example, the basis weight of the fifth wrapper 245 may be within a range of 57 $g/m^2$ to 63 $g/m^2$. Preferably, it may be about 60 $g/m^2$. Also, the total thickness of the fifth wrapper 245 may be within a range of 64 μm to 70 μm. Preferably, it may be 67 μm.

A predetermined material may be included in the fifth wrapper 245. Here, an example of the predetermined material may be, but is not limited to, silicon. For example, silicon exhibits characteristics like heat resistance with little change due to the temperature, oxidation resistance, resistances to various chemicals, water repellency, electrical insulation, etc. However, any material other than silicon may be applied to (or coated on) the fifth wrapper 245 without limitation as long as the material has the above-mentioned characteristics.

The fifth wrapper 245 may prevent the cigarette 2 from being burned. For example, when the tobacco rod 210 is heated by the heater 13, there is a possibility that the cigarette 2 is burned. In detail, when the temperature is raised to a temperature above the ignition point of any one of materials included in the tobacco rod 210, the cigarette 2 may be burned. Even in this case, since the fifth wrapper 245 include a non-combustible material, the burning of the cigarette 2 may be prevented.

Furthermore, the fifth wrapper 245 may prevent the aerosol generating device 1 from being contaminated by substances formed by the cigarette 2. Through puffs of a user, liquid substances may be formed in the cigarette 2. For example, as the aerosol formed by the cigarette 2 is cooled by the outside air, liquid materials (e.g., moisture, etc.) may be formed. As the fifth wrapper 245 wraps the cigarette 2, the liquid materials formed in the cigarette 2 may be prevented from being leaked out of the cigarette 2.

The tobacco rod 21 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21 may include other additives, such as flavors, a wetting agent, and/or organic acid. Also, the tobacco rod 21 may include a flavored liquid, such as menthol or a moisturizer, which is injected to the tobacco rod 21.

The tobacco rod 21 may be manufactured in various forms. For example, the tobacco rod 21 may be formed as a sheet or a strand. Also, the tobacco rod 21 may be formed as a pipe tobacco, which is formed of tiny bits cut from a tobacco sheet. Also, the tobacco rod 21 may be surrounded by a heat conductive material. For example, the heat-conducting material may be, but is not limited to, a metal foil such as aluminum foil. For example, the heat conductive material surrounding the tobacco rod 21 may uniformly distribute heat transmitted to the tobacco rod 21, and thus, the heat conductivity applied to the tobacco rod may be increased and taste of the tobacco may be improved. Also, the heat conductive material surrounding the tobacco rod 21 may function as a susceptor heated by the induction heater. Here, although not illustrated in the drawings, the tobacco rod 21 may further include an additional susceptor, in addition to the heat conductive material surrounding the tobacco rod 21.

The filter rod 22 may include a cellulose acetate filter. Shapes of the filter rod 22 are not limited. For example, the filter rod 22 may include a cylinder-type rod or a tube-type rod having a hollow inside. Also, the filter rod 22 may include a recess-type rod. When the filter rod 22 includes a plurality of segments, at least one of the plurality of segments may have a different shape.

The first segment of the filter rod 22 may be a cellulous acetate filter. For example, the first segment may be a tube-type structure having a hollow inside. The first segment may prevent an internal material of the tobacco rod 21 from being pushed back when the heater 13 is inserted into the tobacco rod 21 and may also provide a cooling effect to aerosol. A diameter of the hollow included in the first segment may be an appropriate diameter within a range of 2 mm to 4.5 mm but is not limited thereto.

The length of the first segment may be an appropriate length within a range of 4 mm to 30 mm but is not limited thereto. Preferably, the length of the first segment may be 10 mm but is not limited thereto.

Hardness of the first segment may be adjusted by adjusting a content of a plasticizer when the first segment is manufactured. Also, the first segment may be manufactured by inserting a structure such as a film or tube of the same or different material, into the inside thereof (e.g., the hollow).

The second segment of the filter rod 22 cools the aerosol which is generated when the heater 13 heats the tobacco rod 21. Therefore, the user may puff the aerosol which is cooled at an appropriate temperature.

The length or diameter of the second segment may be variously determined according to the shape of the cigarette 2. For example, the length of the second segment may be an appropriate length within a range of 7 mm to 20 mm. Preferably, the length of the second segment may be about 14 mm but is not limited thereto.

The second segment may be manufactured by weaving a polymer fiber. In this case, a flavoring liquid may also be applied to the fiber formed of the polymer. Alternatively, the second segment may be manufactured by weaving together an additional fiber coated with a flavoring liquid and a fiber formed of a polymer. Alternatively, the second segment may be formed by a crimped polymer sheet.

For example, a polymer may be formed of a material selected from the group consisting of polyethylene (PE), polypropylene (PP), polyvinyl chloride (PVC), polyethylene terephthalate (PET), polylactic acid (PLA), cellulous acetate (CA), and aluminum coil.

As the second segment is formed by the woven polymer fiber or the crimped polymer sheet, the second segment may include a single channel or a plurality of channels extending in a longitudinal direction. Here, a channel refers to a passage through which a gas (e.g., air or aerosol) passes.

For example, the second segment formed of the crimped polymer sheet may be formed from a material having a thickness between about 5 μm and about 300 μm, for example, between about 10 μm and about 250 μm. Also, a total surface area of the second segment may be between about 300 $mm^2$/mm and about 1000 $mm^2$/mm. In addition, an aerosol cooling element may be formed from a material having a specific surface area between about 10 $mm^2$/mg and about 100 $mm^2$/mg.

The second segment may include a thread including a volatile flavor component. Here, the volatile flavor component may be menthol but is not limited thereto. For example, the thread may be filled with a sufficient amount of menthol to provide the second segment with menthol of 1.5 mg or more.

The third segment of the filter rod 22 may be a cellulous acetate filter. The length of the third segment may be an appropriate length within a range of 4 mm to 20 mm. For example, the length of the third segment may be about 12 mm but is not limited thereto.

In a manufacturing process of the third segment, a flavoring liquid may be injected onto the third segment to generate flavors. Alternatively, an additional fiber coated with a flavoring liquid may be inserted into the third segment. The aerosol generated in the tobacco rod 21 is cooled by passing through the second segment of the filter rod 22, and the cooled aerosol is delivered to the user through the third segment. Therefore, by adding a flavoring element to the third segment, the persistence of flavor delivered to the user may be enhanced.

Also, the filter rod 22 may include at least one capsule 23. Here, the capsule 23 may generate a flavor or an aerosol. For example, the capsule 23 may have a configuration in which a liquid including a flavoring material is wrapped with a film. The capsule 23 may have a spherical or cylindrical shape but is not limited thereto.

Referring to FIG. 5, a cigarette 3 may further include a front-end plug 33. The front-end plug 33 may be located on a side of a tobacco rod 31, the side not facing a filter rod 32. The front-end plug 33 may prevent the tobacco rod 31 from being detached and prevent liquefied aerosol from flowing into the aerosol generating device 1 (FIGS. 1 through 3) from the tobacco rod 31, during smoking.

The filter rod 32 may include a first segment 321 and a second segment 322. Here, the first segment 321 may correspond to the first segment of the filter rod 22 of FIG. 4, and the segment 322 may correspond to the third segment of the filter rod 22 of FIG. 4.

A diameter and a total length of the cigarette 3 may correspond to the diameter and a total length of the cigarette 2 of FIG. 4. For example, a length of the front-end plug 33 may be about 7 mm, a length of the tobacco rod 31 may be about 15 mm, a length of the first segment 321 may be about 12 mm, and a length of the second segment 322 may be about 14 mm, but embodiments are not limited thereto.

The cigarette 3 may be wrapped using at least one wrapper 35. The wrapper 35 may have at least one hole through which external air may be introduced or internal air may be discharged. For example, the front-end plug 33 may be wrapped using a first wrapper 351, the tobacco rod 31 may be wrapped using a second wrapper 352, the first segment 321 may be wrapped using a third wrapper 353, and the second segment 322 may be wrapped using a fourth wrapper 354. Also, the entire cigarette 3 may be re-wrapped using a fifth wrapper 355.

In addition, the fifth wrapper 355 may have at least one perforation 36 formed therein. For example, the perforation 36 may be formed in an area of the fifth wrapper 355 surrounding the tobacco rod 31 but is not limited thereto. The perforation 36 may transfer heat formed by the heater 13 illustrated in FIGS. 2 and 3 into the tobacco rod 31.

Also, the second segment 322 may include at least one capsule 34. Here, the capsule 34 may generate a flavor or aerosol. For example, the capsule 34 may have a configuration in which a liquid including a flavoring material is wrapped with a film. The capsule 34 may have a spherical or cylindrical shape but is not limited thereto.

The first wrapper 351 may be formed by combining general filter wrapping paper with a metal foil such as an aluminum coil. For example, a total thickness of the first wrapper 351 may be within a range of 45 μm to 55 μm. Preferably, it may be 50.3 μm. Also, a thickness of the metal coil of the first wrapper 351 may be within a range 6 μm to 7 μm. Preferably, it may be 6.3 μm. In addition, a basis weight of the first wrapper 351 may be within a range of 50 $g/m^2$ to 55 $g/m^2$. Preferably, it may be 53 $g/m^2$.

The second wrapper 352 and the third wrapper 353 may be formed of general filter wrapping paper. For example, the second wrapper 352 and the third wrapper 353 may be porous wrapping paper or non-porous wrapping paper.

For example, porosity of the second wrapper 352 may be 35000 CU but is not limited thereto. Also, a thickness of the second wrapper 352 may be within a range of 70 μm to 80 μm. Preferably, it may be 78 μm. A basis weight of the second wrapper 352 may be within a range of 20 g/m2 to 25 g/m2. Preferably, it may be 23.5 $g/m^2$.

For example, porosity of the third wrapper 353 may be 24000 CU but is not limited thereto. Also, a thickness of the third wrapper 353 may be in a range of about 60 μm to about 70 μm, alternatively, may be 68 μm. A basis weight of the third wrapper 353 may be in a range of about 20 g/m2 to about 25 g/m2, alternatively, may be 21 g/m2.

The fourth wrapper 354 may be formed of PLA laminated paper. Here, the PLA laminated paper refers to three-layer paper including a paper layer, a PLA layer, and a paper layer. For example, a thickness of the fourth wrapper 353 may be in a range of 100 μm to 120 μm. Preferably, it may be 110 μm. Also, a basis weight of the fourth wrapper 354 may be in a range of 80 $g/m^2$ to 100 $g/m^2$. Preferably, it may be 88 $g/m^2$.

The fifth wrapper 355 may be formed of sterilized paper (MFW). Here, the sterilized paper (MFW) refers to paper which is particularly manufactured to improve tensile strength, water resistance, smoothness, and the like more than ordinary paper. For example, a basis weight of the fifth wrapper 355 may be in a range of 57 $g/m^2$ to 63 $g/m^2$, alternatively, may be 60 $g/m^2$. Also, a thickness of the fifth wrapper 355 may be in a range of 64 μm to 70 μm. Preferably, it may be 67 μm.

The fifth wrapper 355 may include a preset material added thereto. An example of the material may include silicon, but it is not limited thereto. Silicon has characteristics such as heat resistance robust to temperature conditions, oxidation resistance, resistance to various chemicals, water repellency to water, and electrical insulation, etc. Besides silicon, any other materials having characteristics as described above may be applied to (or coated on) the fifth wrapper 355 without limitation.

The front-end plug 33 may be formed of cellulous acetate. For example, the front-end plug 33 may be formed by adding a plasticizer (e.g., triacetin) to cellulous acetate tow. Mono-denier of filaments constituting the cellulous acetate tow may be in a range of 1.0 to 10.0. Preferably, it may be within a range of 4.0 to 6.0. For example, the mono-denier of the filaments of the front-end plug 33 may be 5.0. Also, a cross-section of the filaments constituting the front-end plug 33 may be a Y shape. Total denier of the front-end plug 33 may be in a range of 20000 to 30000. Preferably, it may be within a range of 25000 to 30000. For example, the total denier of the front-end plug 33 may be 28000.

Also, as needed, the front-end plug 33 may include at least one channel, and a cross-sectional shape of the channel may be manufactured in various shapes.

The tobacco rod 31 may correspond to the tobacco rod 21 described above with reference to FIG. 4. Therefore, hereinafter, the detailed description of the tobacco rod 31 will be omitted.

The first segment 321 may be formed of cellulous acetate. For example, the first segment 321 may be a tube-type structure having a hollow inside. The first segment 321 may be manufactured by adding a plasticizer (e.g., triacetin) to cellulous acetate tow. For example, mono-denier and total denier of the first segment 321 may be the same as the mono-denier and total denier of the front-end plug 33.

The second segment 322 may be formed of cellulous acetate. Mono denier of filaments constituting the second segment 322 may be in a range of 1.0 to 10.0. Preferably, it may be within a range of about 8.0 to about 10.0. For example, the mono denier of the filaments of the second segment 322 may be 9.0. Also, a cross-section of the filaments of the second segment 322 may be a Y shape. Total denier of the second segment 322 may be in a range of 20000 to 30000. Preferably, it may be 25000.

Figure 6:
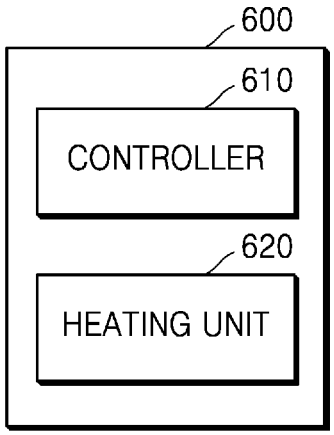
FIG. 6 is a block diagram of an aerosol generating device according to an embodiment.

FIG. 6 is a block diagram of an aerosol generating device 600 according to an embodiment.

The aerosol generating device 600 may include a controller 610 and a heater 620. While FIG. 6 illustrates only components related to the present embodiment, it will be understood by one of ordinary skill in the art that other general-purpose components may be further included.

The embodiment of the aerosol generating device 1 of FIGS. 1 through 3 may be applied to the aerosol generating device 600. The controller 610 may correspond to the controller 12 of FIGS. 1 through 3. Also, the heater 620 may correspond to the heater 13 of FIG. 1 or the vaporizer 14 of FIGS. 2 and 3.

The heater 620 may heat an aerosol generating material to generate an aerosol. The heater 620 may be supplied with power from a power source. The heater 620 may generate heat energy from electric energy supplied from the power source. The heater 620 may heat the aerosol generating material by transferring heat to the aerosol generating material.

For example, in a heating mode, the heater 620 may heat the aerosol generating material at a temperature sufficient to generate the aerosol. In a preheating mode distinguished from the heating mode, the heater 620 may heat the aerosol generating material at a temperature lower than a temperature at which the aerosol is generated. Also, in a power saving mode, the heater 620 may heat the aerosol generating material at a temperature lower than in the preheating mode.

A temperature at which the heater 620 heats the aerosol generating material may be different in the heating mode, the preheating mode, and the power saving mode. The heating mode, the preheating mode, and the power saving mode may be distinguished from one another according to an amount of power supplied to the heater 620, the amount of power being controlled by the controller 610.

The controller 610 may include at least one processor. A processor may be implemented as an array of a plurality of logic gates or may be implemented as a combination of a general-purpose microprocessor and a memory in which a program executable in the microprocessor is stored. Also, it will be understood by one of ordinary skill in the art that the processor may be implemented in other forms of hardware.

For example, the controller 610 may determine a mode of the aerosol generating device 600 as the heating mode during a puff period from a puff start time point to a puff end time point. Here, the controller 610 may determine the puff start time point and the puff end time point on the basis of a change in an air flow generated by a puff or a change in pressure caused by the air flow change.

As another example, the controller 610 may determine the mode of the aerosol generating device 600 as the heating mode during a preset period from a puff start time point. Here, the puff end time point may refer to a time point when a preset period expires from the puff start time point. In the heating mode, the controller 610 may control the amount of power supplied to the heater 620 to heat the aerosol generating material at an aerosol generating temperature.

On determining that the puff has ended, the controller 610 may change the mode of the aerosol generating device 600 from the heating mode to the preheating mode. In the preheating mode, the controller 610 may control an amount of power supplied to the heater 620 such that the heater 620 heats the aerosol generating material at a preheating temperature that is lower than the aerosol generating temperature.

Here, the amount of power supplied to the heater 620 in the heating mode may be greater than the amount of power supplied to the heater 620 in the preheating mode. For example, the heater 620 may be supplied with power by using a PWM pulse signal. Here, the controller 610 may control the amount of power supplied to the heater 620 by adjusting a duty cycle of the PWM pulse signal. The controller 610 may increase or decrease the duty cycle to increase or decrease the amount of power supplied to the heater 620. As another example, the controller 610 may control the amount of power supplied to the heater 620 by adjusting a frequency of the PWM pulse signal. For example, the controller 610 may increase or decrease the frequency of the PWM pulse signal to increase or decrease the amount of power supplied to the heater 620. It will be understood by one of ordinary skill in the art that the amount of power supplied to the heater 620 may also be adjusted by adjusting amplitude or using other types of signals.

In the preheating mode, the controller 610 may variably increase the amount of power supplied to the heater 620 to heat the aerosol generating material at the preheating temperature lower than a heating temperature. Within a range of an amount of power that is less than the amount of power supplied to the heater 620 in the heating mode, the controller 610 may gradually increase the amount of power supplied to the heater 620.

The preheating mode may include a plurality of phases. Here, a phase refers to a time interval in which an amount of power supplied is kept constant. A change in a phase with time may indicate that an amount of power supplied to the heater 620 changes at preset time intervals with time. Here, the changing time interval is a duration of the phase. In other words, the duration of the phase refers to a period in which an amount of power supplied is continuously maintained. Respective durations of the plurality of phases may be different.

The controller 610 may change the phases in a direction of increasing an amount of power supplied in the preheating mode. In other words, an amount of power supplied in a following phase may be greater than an amount of power supplied in a preceding phase over time. When the mode of the aerosol generating device 600 changes from the heating mode to the preheating mode, since the initial temperature of the heater 620 is relatively high, relatively low power may be supplied to the heater 620 in consideration of remaining heat energy. Then, as the heat energy remaining in the heater 620 gradually decreases, relatively high power may be supplied to the heater 620.

As another example, the controller 610 may change the phases in a direction of decreasing an amount of power supplied or a direction of increasing the amount of power supplied and then decreasing the amount of power supplied. Alternatively, the amount of power supplied may be changed in various patterns.

Also, the controller 610 may change the phases in a direction of increasing the durations of the phases in the preheating mode. As the mode changes from the heating mode to the preheating mode, the amount of power supplied in the heating mode just before the preheating mode may be significantly different from the amount of power supplied in the early stage of the preheating mode, and thus, the temperature of the heater 620 may decrease rapidly. Therefore, to cope with the rapid change in the temperature of the heater 620, the controller 610 may shorten the durations of the phases, and, as the temperature of the heater 620 gradually stabilizes in the range of the preheating temperature, increase the durations of the phases. Alternatively, the durations of the phases may be changed in various patterns.

The controller 610 may change the mode of the aerosol generating device 600 from the preheating mode to the power saving mode. For example, when a puff of the user is not detected during a preset preheating period in the preheating mode, the controller 610 may change the mode of the aerosol generating device 600 from the preheating mode to the power saving mode. In this case, an amount of power supplied to the heater 620 in the power saving mode may be smaller than the amount of power supplied to the heater 620 in the preheating mode. When a puff of the user is not detected during a preset period, power consumption may be reduced by stopping preheating of the heater 620 and reducing power supplied.

For example, the controller 610 may determine a preheating period on the basis of a predicted value of a puff interval between consecutive puff time points of the user. Also, the controller 610 may determine the preheating period on the basis of a remaining amount of energy stored in a power source. As the predicted value of the puff interval is shorter and the remaining amount of energy is smaller, the preheating period may be determined to be short.

For example, as the predicted value of the puff interval is shorter or the remaining amount of energy is smaller, the controller 610 may shorten a duration of a phase in which relatively high power is supplied to the heater 620, among a plurality of phases of the preheating period.

Also, the controller 610 may determine a cumulative value of the amount of power supplied to the heater 620 in the preheating mode. When the determined cumulative amount of power supplied is greater than a preset threshold value, the controller 610 may change the mode of the aerosol generating device 600 from the preheating mode to the power saving mode. Here, the controller 610 may adjust the threshold value on the basis of the remaining amount of energy. For example, as the remaining amount of energy is smaller, the controller 610 may decrease the threshold value of the cumulative amount of power supplied.

For example, the controller 610 may determine a preheating period on the basis of a predicted value of a puff interval. In this case, as the remaining amount of energy is smaller, the controller 610 may shorten a duration of a phase in which relatively high power is supplied to the heater 620 during the determined preheating period.

Figure 7:
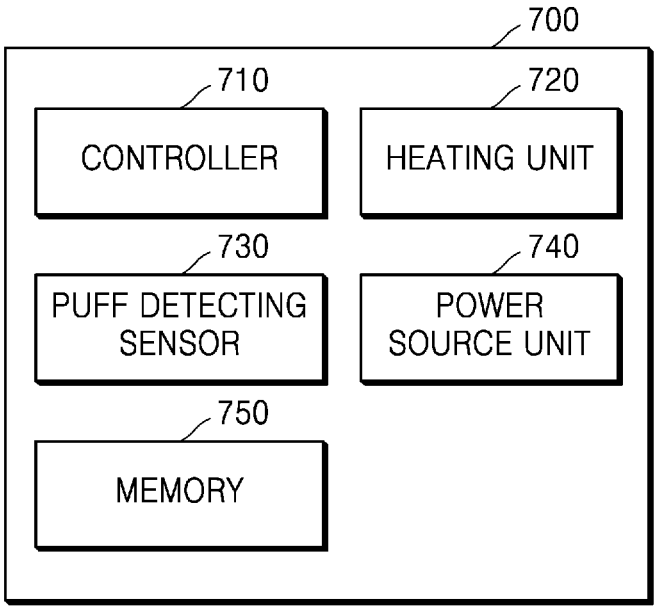
FIG. 7 is a detailed block diagram of an aerosol generating device according to an embodiment.

FIG. 7 is a detailed block diagram of an aerosol generating device 700 according to an embodiment.

The aerosol generating device 700 of FIG. 7 may include a controller 710, a heater 720, a puff detecting sensor 730, a power source 740, and a memory 750.

The controller 710 and the heater 720 of FIG. 7 may respectively correspond to the controller 610 and the heater 620 of FIG. 6. Also, the power source 740 may correspond to the battery 11 of FIGS. 1 through 3.

The puff detecting sensor 730 may be used to detect a puff of a user. For example, the puff detecting sensor 730 may include a pressure detecting sensor. The pressure detecting sensor may be arranged in an air passage formed in the aerosol generating device 700. As a flow of air is generated in the aerosol generating device 700 by a user's puff, the puff detecting sensor 730 may detect a change in pressure and output the detected change in pressure or a signal corresponding to changed pressure. The controller 710 may detect a puff on the basis of the output signal of the puff detecting sensor 730.

The controller 710 may acquire information about a puff start, a puff end, and a puff interval of the user on the basis of the output signal of the puff detecting sensor 730. For example, the controller 710 may set a mode of the aerosol generating device 700 to a heating mode during a puff period from a start time point of a puff to an end time point of the puff. Also, the controller 710 may continuously collect information about the puff interval to determine an average puff interval of the user. Here, the average puff interval may be used to determine a preheating period as described above with reference to FIG. 6. In other words, as the average puff interval is shorter, the controller 710 may reduce the preheating period.

The controller 710 may control the memory 750 to store information for control of the aerosol generating device 700 or history information regarding a smoking habit of the user. For example, the controller 710 may control the memory 750 to store information about the puff start time point or puff end time point of the user, information about the puff interval, or the like.

The power source 740 may supply power for an operation of the aerosol generating device 700. For example, the power source 740 may supply the heater 720 with electric energy needed for generating heat energy for heating an aerosol generating material. In this case, the controller 710 may control an amount of power supplied to the heater 720 by controlling a power signal output from the power source 740.

For example, the controller 710 may generate a PWM pulse signal from an electrical signal output from the power source 740 and supply the generated PWM pulse signal to the heater 720. In this case, the controller 710 may control the amount of power supplied to the heater 720 by adjusting a duty cycle of the PWM pulse signal.

For example, the power source 740 may include a battery. The controller 710 may detect an output voltage and a remaining amount of charged energy of the battery. As described above with reference to FIG. 6, the controller 710 may determine a preheating period on the basis of the detected remaining amount of energy. For example, as the detected remaining amount of energy is smaller, the controller 710 may shorten the preheating period to reduce power consumption.

Also, for example, the power source 740 may determine the preheating period on the basis of an output signal of a temperature sensor measuring a temperature of the heater 720.

Figure 8A:
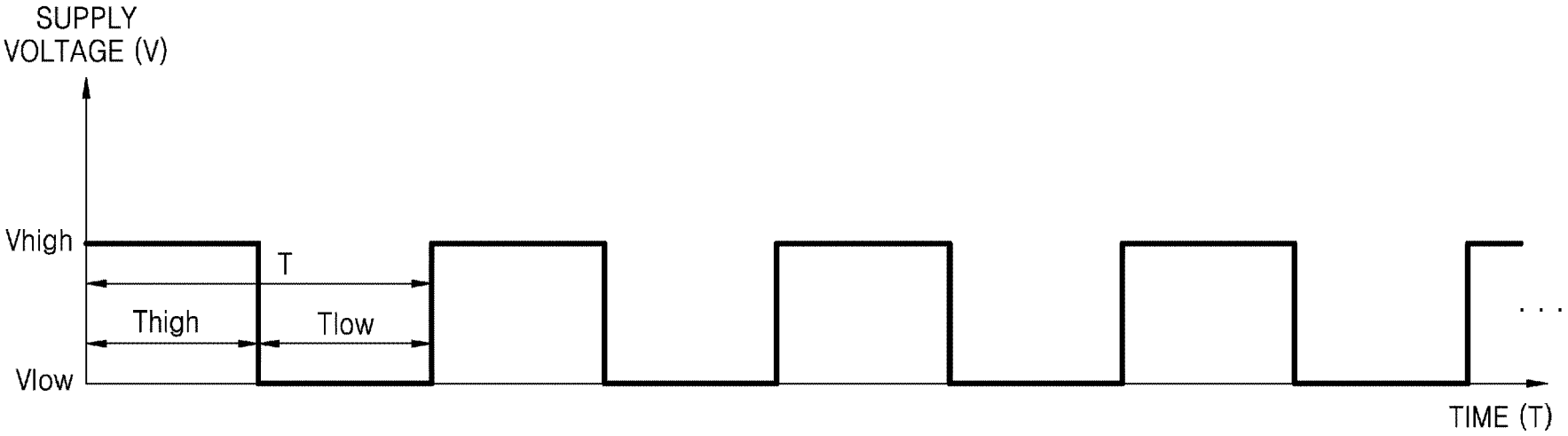
FIGS. 8A through 8C are views for explaining a pulse signal of a pulse width modulation (PWM) method.
Figure 8B:
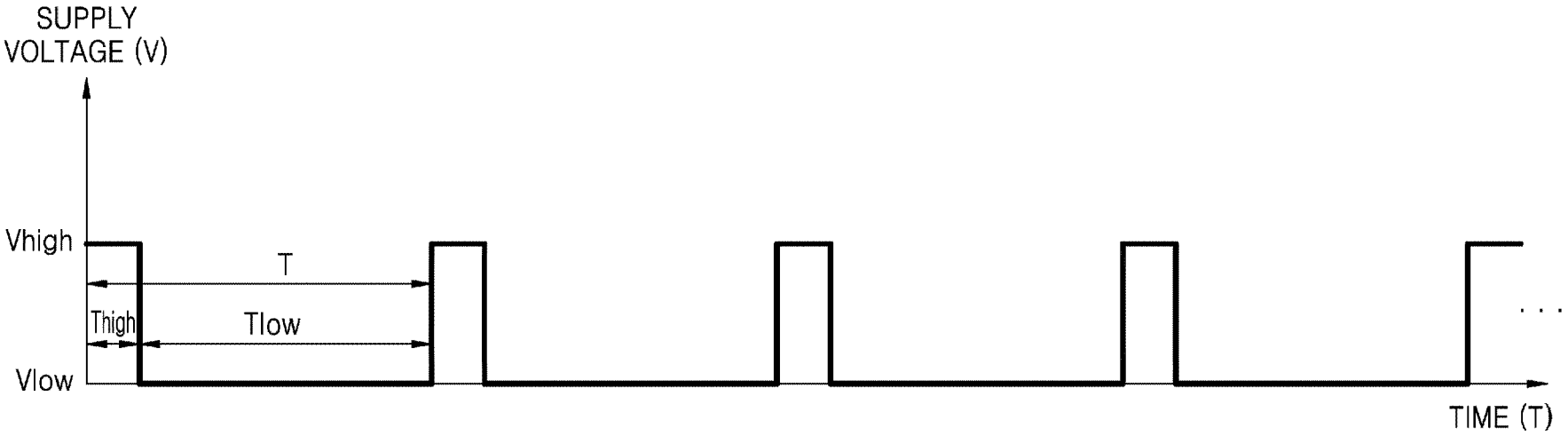
Figure 8C:
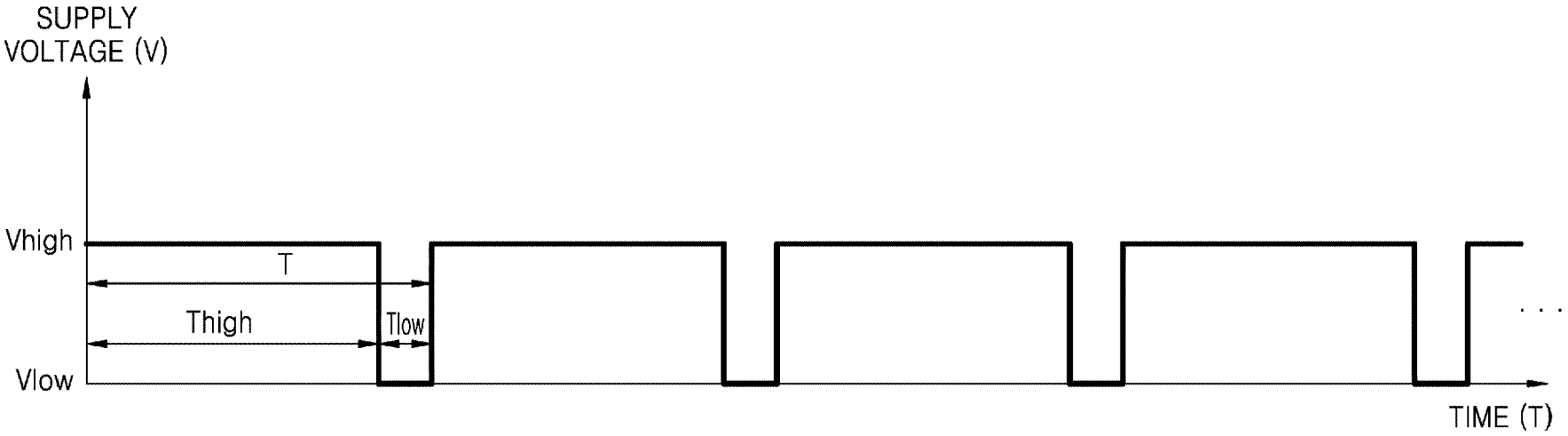

FIGS. 8A through 8C are views for explaining a pulse signal of a pulse width modulation (PWM) method.

PWM is a method of converting an analog signal into a digital signal. A PWM pulse signal is a signal where a high output signal Vhigh and a low output signal Vlow are repeated at regular intervals. In FIGS. 8A through 8C, T denotes a period of the PWM pulse signal, Thigh denotes a time period for which the high output signal Vhigh is maintained, and Tlow denotes a time period for which the low output signal Vlow is maintained.

Here, a ratio of the time period Thigh, for which the high output signal Vhigh is maintained, out of the period T of the PWM pulse signal is referred to as a duty cycle.

In the PWM pulse signal illustrated in FIG. 8A, a duty cycle is 50%, and the time period Thigh for which the high output signal Vhigh is maintained and the time period Tlow for which the low output signal Vlow is maintained are the same.

In the PWM pulse signal illustrated in FIG. 8B, the duty cycle is less than 50%, and the time period Thigh for which the high output signal Vhigh is maintained is shorter than the time period Tlow for which the low output signal Vlow is maintained. For example, to supply relatively low power, a controller may control a duty cycle of a PWM pulse signal, which is a power supply signal, within a range of 3% to 20% in a preheating mode and control the duty cycle to be lower than the above range in a power saving mode.

In the PWM pulse signal illustrated in FIG. 8C, the duty cycle is greater than or equal to 50%, and the time period Thigh for which the high output signal Vhigh is maintained is longer than the time period Tlow for which the low output signal Vlow is maintained. For example, the controller may control the duty cycle of the PWM pulse signal, which is the power supply signal, within a range of about 70% to about 95% to supply relatively high power in a heating mode.

Figure 9:
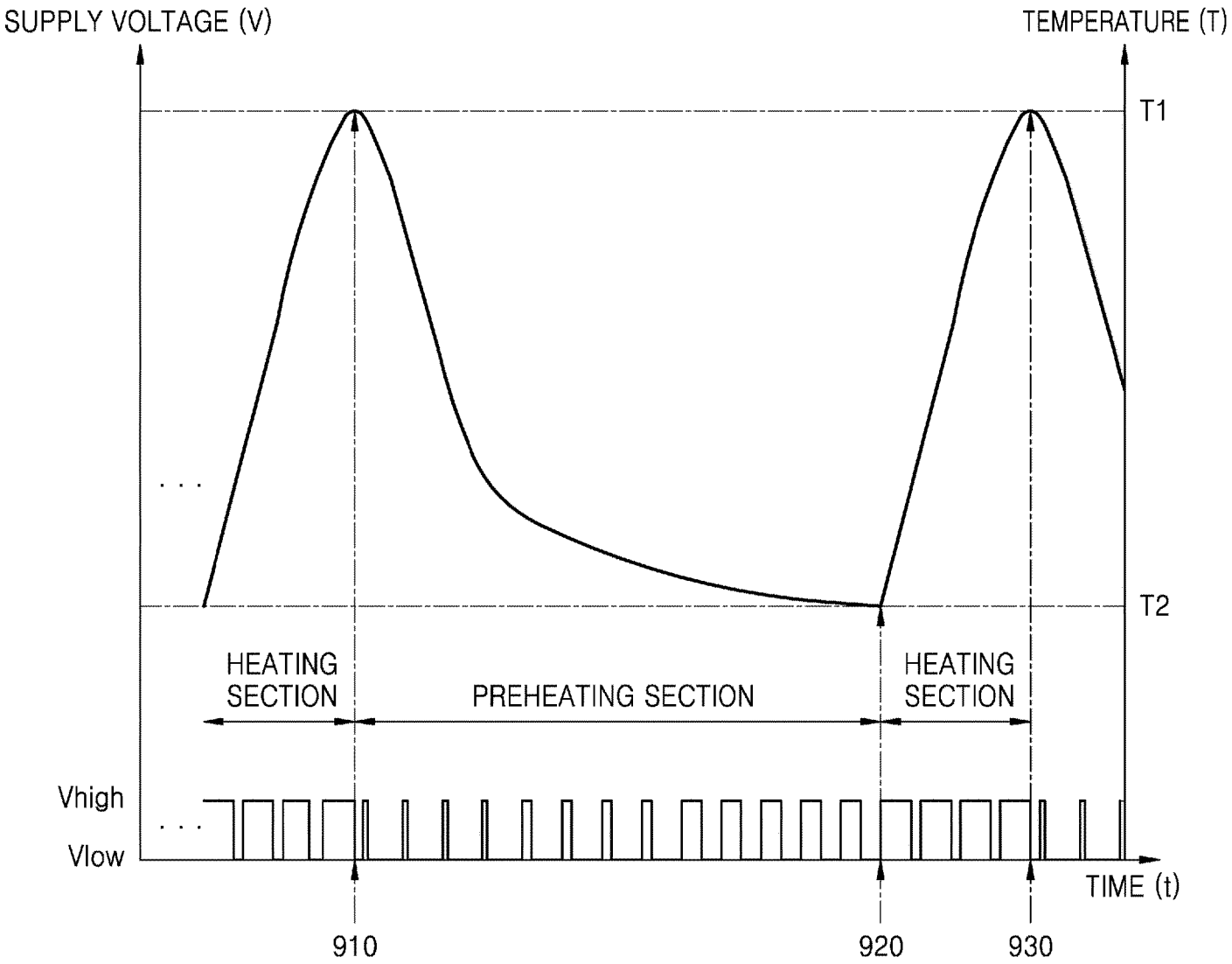
FIGS. 9 and 10 are views illustrating examples of a change in a duty cycle of a PWM pulse signal and a change in a temperature of a heater over time.
Figure 10:
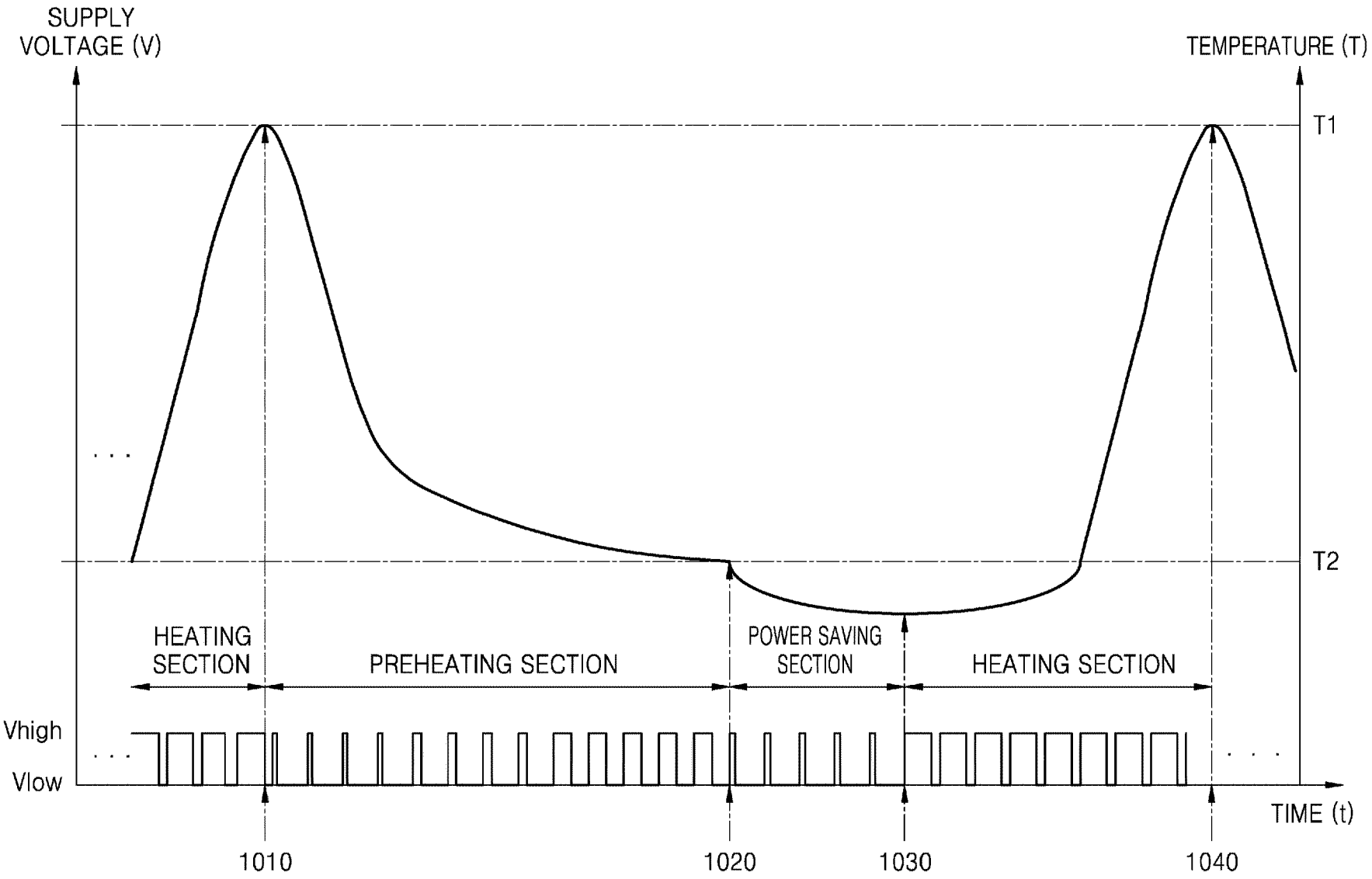

FIGS. 9 and 10 are views illustrating examples of a change in a duty cycle of a PWM pulse signal and a change in a temperature of a heater over time.

In FIGS. 9 and 10, a horizontal axis denotes time, a left vertical axis denotes a voltage of a PWM pulse signal which is a power supply signal, and a right vertical axis denotes a temperature of a heater or a temperature of an aerosol generating material.

In FIGS. 9 and 10, a heating section, a preheating section, and a power saving section respectively denote a duration of a heating mode, a duration of a preheating mode, and a duration of a power saving mode.

In FIG. 9, as a PWM power signal having a relatively high duty cycle is supplied in the heating section, the temperature of the heater rises to a heating temperature T1. The preheating section starts at a time point 910. In the preheating section, three phases appear as the duty cycle changes. The duty cycle is constant in each of the three phases. The duty cycle in a first phase, which is an initial section of the preheating section, may be less than a duty cycle in the other phases of the preheating section. As described above, since the temperature of the heater is high in the heating section, although a relatively small amount of power is supplied to the heater, the temperature of the heater may be maintained in a preheating temperature range, for example, in a range including T2 and an adjacent temperature thereof. Here, since a difference in a duty cycle is large before and after the time point 910, i.e., since an amount of power supplied decreases rapidly, the temperature of the heater may also decrease rapidly. Therefore, to cope with the rapid change in the temperature of the heater in an initial phase of the preheating section, an amount of power supplied may be rapidly adjusted by shortening a duration of the initial phase.

Thereafter, as the temperature of the heater stabilizes in the preheating temperature range, the phase may be changed by increasing gradually the duty cycle. Also, when a puff is detected within a preset preheating period in the preheating section, the temperature of the heater may be increased to a heating temperature T1 by increasing the duty cycle again. For example, in FIG. 9, as a puff is detected at a time point 920 while the preheating section is continued, a relatively high duty cycle is maintained during a heating period from the time point 920 to a time point 930. Therefore, the temperature of the heater rises again to the heating temperature T1.

FIG. 10 illustrates an embodiment in which a preheating mode is changed to a power saving mode because a puff is not detected during a preset preheating period.

When the preset preheating period passes after a preheating section starts at a time point 1010, a power saving section starts at a time point 1020. In the power saving mode, a PWM pulse signal having a duty cycle lower than a duty cycle needed for maintaining a preheating temperature in the preheating section is supplied. Therefore, the temperature of the heater decreases to a temperature lower than a range of the preheating temperature. When a preset time passes in the power saving section, a controller may stop supplying power to the heater. FIG. 10 illustrates an embodiment in which a puff of a user is detected in the power saving section. Here, as the puff of the user is detected at a time point 1030, a mode is changed from the power saving mode to a heating mode again. As a high duty cycle is maintained again from the time point 1030 to a time point 1040, the temperature of the heater rises again to a heating temperature T1.

FIGS. 11A through 11D are views for explaining various embodiments of a duty cycle change method of a PWM pulse signal over time.

Figure 11A:
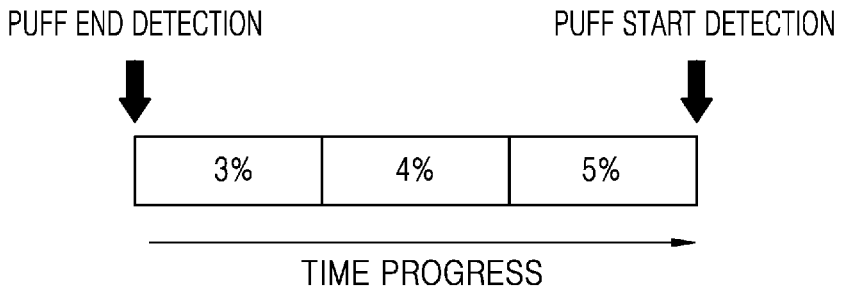
FIGS. 11A through 11D are views for explaining various embodiments of a method of change of a duty cycle of a PWM pulse signal over time.
Figure 11B:
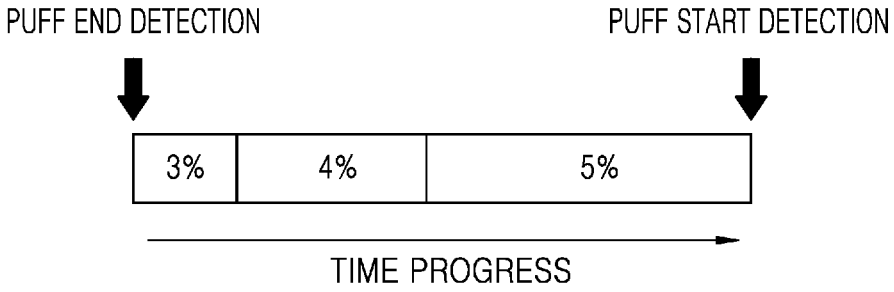
Figure 11C:
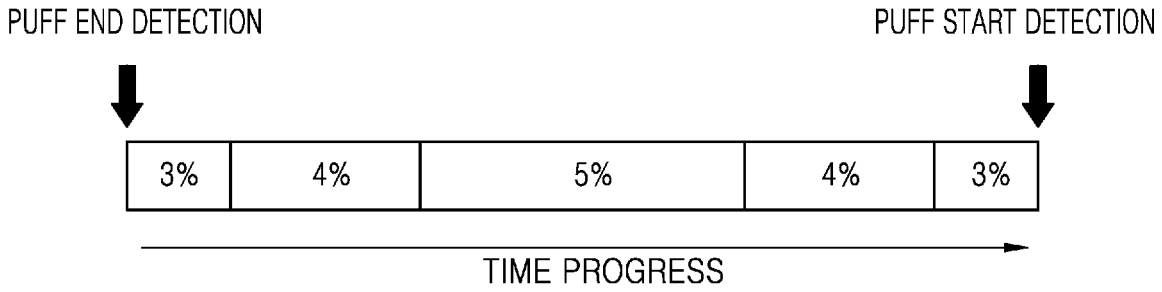

FIGS. 11A through 11C illustrate change patterns of phases included in a preheating section from a time point when an end of a preceding puff is detected to a time point when a start of a next puff is detected.

For example, each cell denotes a phase, and a number written inside each cell denotes a duty cycle of a corresponding phase. Also, a width of each cell denotes a duration of a corresponding phase.

FIGS. 11A and 11B illustrate a preheating section including three phases. Here, a duty cycle of a phase gradually increases in the order of 3%, 4%, and 5%. While durations of the three phases are all the same in FIG. 11A, the durations of the three phases gradually increase in FIG. 11B.

FIG. 11C illustrates a preheating section including five phases. Here, a duty cycle of a phase increases and then decreases, in the order of 3%, 4%, 5%, 4%, and 3%. In this case, a duration of a third phase in which a relatively high duty cycle of 5% is maintained is longer than a duration of a first phase in which a relatively low duty cycle of 3% is maintained. Thereafter, durations of a fourth phase and a fifth phase, where the duty cycle decreases again, gradually decrease.

Figure 11D:
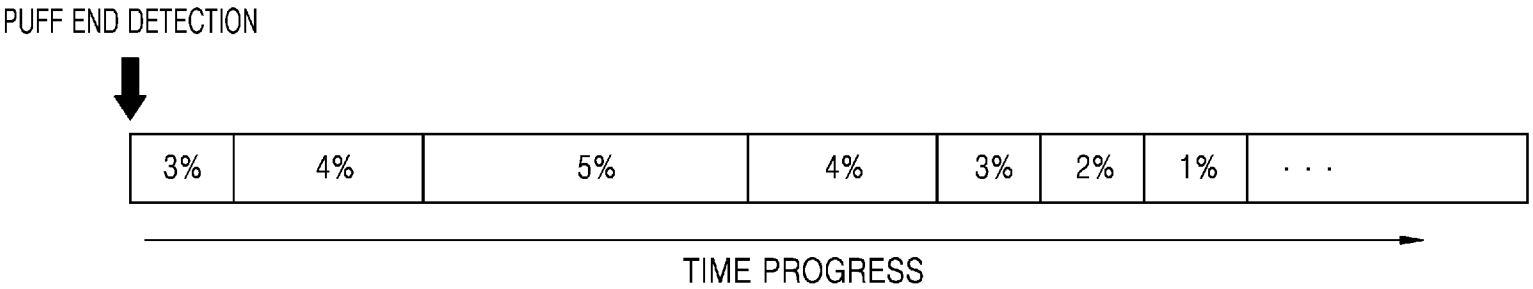

FIG. 11D illustrates an embodiment in which, as a next puff is not detected within a preheating period, a preheating mode is changed to a power saving mode, and thus, a duty cycle gradually decreases. For example, the first three phases may be included in a preheating section, and subsequent phases may be included in a power saving section. In this case, the preheating period may correspond to a total duration of the first three phases, and, as a puff operation is not detected within the preheating period, the duty cycle may gradually decrease in the order of 4%, 3%, 2%, and 1%. In other words, phases starting from a fourth phase belong to the power saving mode.

Figure 12:
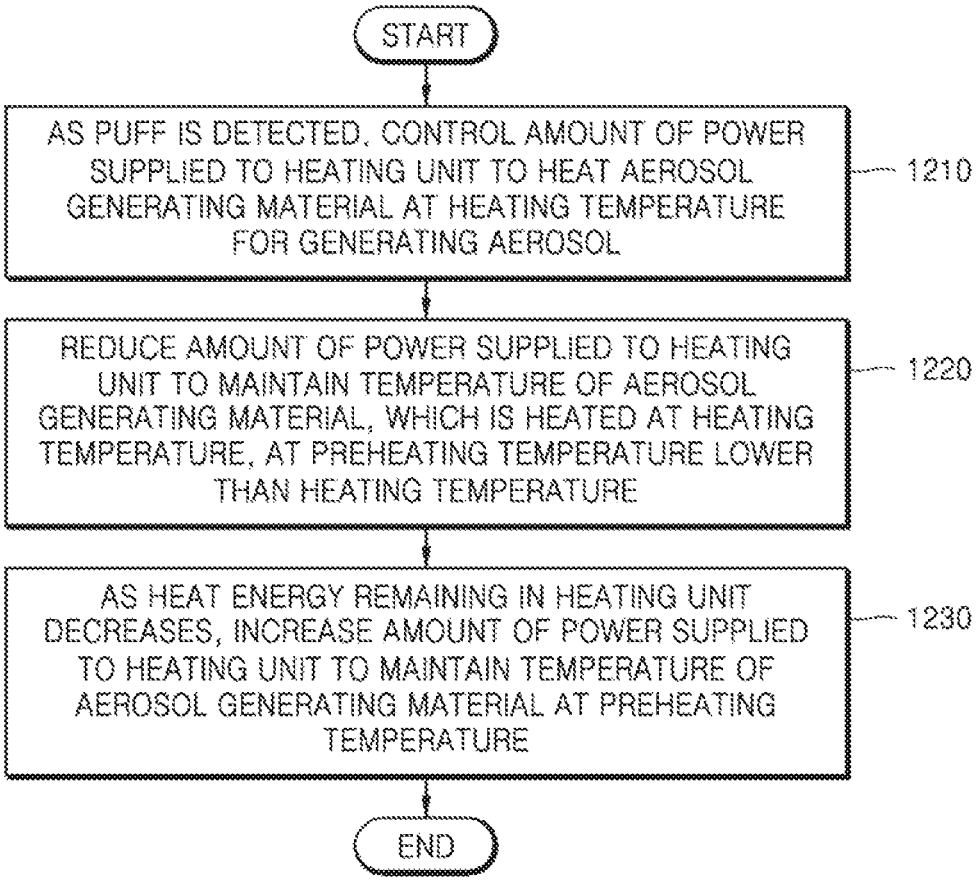
FIG. 12 is a flowchart of a method of control of an aerosol generating device, according to an embodiment.

FIG. 12 is a flowchart of a method of controlling an aerosol generating device, according to an embodiment.

Operations of FIG. 12 may be performed by the controller 610 of FIG. 6.

In operation 1210, a controller may detect a puff and may control an amount of power supplied to a heater to heat an aerosol generating material at a heating temperature for generating aerosol.

In operation 1220, the controller may reduce the amount of power supplied to the heater to maintain a temperature of the aerosol generating material, which is heated at the heating temperature, at a preheating temperature lower than the heating temperature.

In operation 1230, the controller may reduce the amount of power supplied to the heater to maintain the temperature of the aerosol generating material, which is heated at an aerosol heating temperature, at the preheating temperature lower than the heating temperature.

In operation 1240, as heat energy remaining in the heater decreases, the controller may increase the amount of power supplied to the heater to maintain the temperature of the aerosol generating material at the preheating temperature.

Also, when a puff of a user is not detected during a preset preheating period, the controller may reduce an amount of power supplied to the heater to be less than the amount of power supplied to the heater to heat the aerosol generating material at the preheating temperature.

For example, the controller may calculate an average puff interval on the basis of history information about a puff interval between consecutive puff time points, and determine a preheating period on the basis of the calculated average puff interval.

Also, the controller may determine a cumulative supply power amount supplied to the heater while heating the aerosol generating material at the preheating temperature. Here, when the cumulative supply power amount exceeds a preset threshold value, the controller may reduce an amount of power supplied to the heater to be less than the amount of power supplied to the heater to heat the aerosol generating material at the preheating temperature. One of ordinary skill in the art related to the present embodiments may understand that various changes in form and details may be made therein without departing from the scope of the characteristics described above. The disclosed methods should be considered in a descriptive sense only and not for purposes of limitation. The scope of the present disclosure is defined by the appended claims rather than by the forgoing description, and all differences within the scope of the equivalents thereof should be construed as being included in the present disclosure.

What is claimed is:

1. A device for generating aerosol, the device comprising:

a heater configured to heat an aerosol generating material; and a controller configured to control an amount of power supplied to the heater such that the aerosol generating material is heated at a heating temperature for generating the aerosol during a heating period corresponding to a puff, and is then heated at a preheating temperature lower than the heating temperature during a preset preheating period unless a next puff is detected, wherein the amount of power supplied to the heater decreases when the heating period ends, and then gradually increases over time during the preset preheating period following the heating period, and wherein if the next puff is not detected until a heater temperature reaches the preheating temperature during the preset preheating period, the controller is further configured to control the amount of power supplied to the heater, for a preset time, at a duty cycle of pulse width modulation (PWM) pulse signal lower than a duty cycle of a PWM pulse signal required for maintaining the preheating temperature and the heater is heated at a power saving temperature lower than the preheating temperature.

2. The device of claim 1, wherein the controller reduces the amount of power supplied to the heater to be less than an amount of power for heating the aerosol generating material at the preheating temperature, based on the next puff being not detected during the preset preheating period.

3. The device of claim 2, wherein the controller calculates an average puff interval based on history information about a puff interval between time points for consecutive puffs, and determines the preset preheating period based on the calculated average puff interval.

4. The device of claim 2, further comprising a power source providing power supplied to the heater, wherein the controller determines the preset preheating period based on a remaining amount of energy stored in the power source.

5. The device of claim 1, wherein the controller determines a cumulative supply power amount supplied to the heater while the aerosol generating material is heated at the preheating temperature, and based on the cumulative supply power amount exceeding a preset threshold value, reduces the amount of power supplied to the heater to be less than an amount of power for heating the aerosol generating material at the preheating temperature.

6. The device of claim 1, wherein the controller heats the aerosol generating material at the preheating temperature by increasing the amount of power supplied to the heater as heat energy remaining in the heater decreases.

7. The device of claim 1, wherein the duty cycle of a PWM pulse signal supplied to the heater to heat the aerosol generating material at the heating temperature is in a range of 70% to 95%.

8. The device of claim 1, wherein the duty cycle of a PWM pulse signal supplied to the heater to heat the aerosol generating material at the preheating temperature is in a range of 3% to 20%.

9. The device of claim 1, wherein the controller is further configured to stop supplying power to the heater when the preset time passes.

* * * * *